US008784280B2

(12) United States Patent
Krull

(10) Patent No.: US 8,784,280 B2
(45) Date of Patent: Jul. 22, 2014

(54) KETTLEBELL METHODS AND APPARATUS

(76) Inventor: Mark A. Krull, New Braunfels, TX (US)

( * ) Notice: Subject to any disclaimer, the term of this patent is extended or adjusted under 35 U.S.C. 154(b) by 179 days.

(21) Appl. No.: 12/932,847

(22) Filed: Mar. 8, 2011

(65) Prior Publication Data

US 2012/0231936 A1 Sep. 13, 2012

(51) Int. Cl.

| | |
|---|---|
| ***A63B 21/06*** | (2006.01) |
| ***A63B 21/072*** | (2006.01) |
| ***A63B 21/075*** | (2006.01) |
| ***A63B 21/00*** | (2006.01) |

(52) U.S. Cl.

CPC ..... *A63B 21/00065* (2013.01); *A63B 21/072* (2013.01); *A63B 21/00069* (2013.01); *A63B 21/075* (2013.01)

USPC ..... 482/93; 482/106; 482/107; 482/108; D21/682

(58) Field of Classification Search

USPC ..... 482/93, 148, 106–108, 141; D21/662, D21/673, 680–682, 684

See application file for complete search history.

(56) References Cited

U.S. PATENT DOCUMENTS

| | | | | | |
|---|---|---|---|---|---|
| D242,865 | S | * | 12/1976 | Stamm | D21/682 |
| D267,370 | S | * | 12/1982 | Cline | D3/282 |
| D379,715 | S | * | 6/1997 | Yemini | D3/282 |
| D392,711 | S | * | 3/1998 | Decker | D21/678 |
| 6,709,371 | B2 | * | 3/2004 | Wu | 482/108 |
| D522,594 | S | * | 6/2006 | Donahue et al. | D21/682 |
| D526,483 | S | * | 8/2006 | Lay et al. | D3/282 |
| D539,366 | S | * | 3/2007 | Niksich | D21/707 |
| D545,509 | S | * | 6/2007 | Wang | D30/160 |
| D568,950 | S | * | 5/2008 | Yewer, Jr. | D21/662 |
| 7,381,157 | B2 | * | 6/2008 | Blateri | 482/50 |
| 7,491,157 | B1 | * | 2/2009 | Lin | 482/108 |
| 7,678,031 | B2 | * | 3/2010 | Ngu | 482/107 |
| 8,021,282 | B2 | * | 9/2011 | Polevoy et al. | 482/108 |
| 8,454,483 | B1 | * | 6/2013 | Bradley et al. | 482/92 |
| 2007/0087914 | A1 | * | 4/2007 | Connelly et al. | 482/93 |
| 2007/0287608 | A1 | * | 12/2007 | Hallar | 482/104 |
| 2008/0081744 | A1 | * | 4/2008 | Gormley | 482/93 |
| 2010/0048362 | A1 | * | 2/2010 | Liford et al. | 482/93 |
| 2010/0248910 | A1 | * | 9/2010 | DiLuglio | 482/93 |
| 2011/0306475 | A1 | * | 12/2011 | Caswell et al. | 482/93 |
| 2012/0053024 | A1 | * | 3/2012 | Mendoza | 482/106 |

* cited by examiner

*Primary Examiner* — Loan H Thanh
*Assistant Examiner* — Shila Jalalzadeh Abyane

(57) ABSTRACT

An adjustable weight kettlebell includes a weight lifting member that rests on top of a vertical stack of weights. A weight selector is rotatable into and out of underlying engagement of the weight plates to secure a desired amount of mass to the weight lifting member.

35 Claims, 6 Drawing Sheets

KETTLEBELL METHODS AND APPARATUS

CROSS-REFERENCE TO RELATED APPLICATIONS

Disclosed herein is subject matter that is entitled to the filing dates of U.S. patent application Ser. No. 12/590,355, filed Nov. 6, 2009, and U.S. Provisional Application No. 61/198,620, filed Nov. 7, 2008.

FIELD OF THE INVENTION

The present invention relates to exercise equipment and in a preferred application, to methods and apparatus for adjusting weight on an exercise kettlebell.

BACKGROUND OF THE INVENTION

Past efforts have led to various inventions directed toward adjustable weight exercise devices. Despite these advances and others in the field of weight lifting equipment, room for continued improvement remains with respect to adjusting weight resistance to exercise.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of a kettlebell having a handle, a weight supporting section secured to the handle and disposed beneath the handle, and a weight selector that is rotatably mounted on the weight supporting section. Weights are sized and configured to occupy the weight supporting section, and to be selectively engaged and disengaged in response to rotation of the weight selector. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
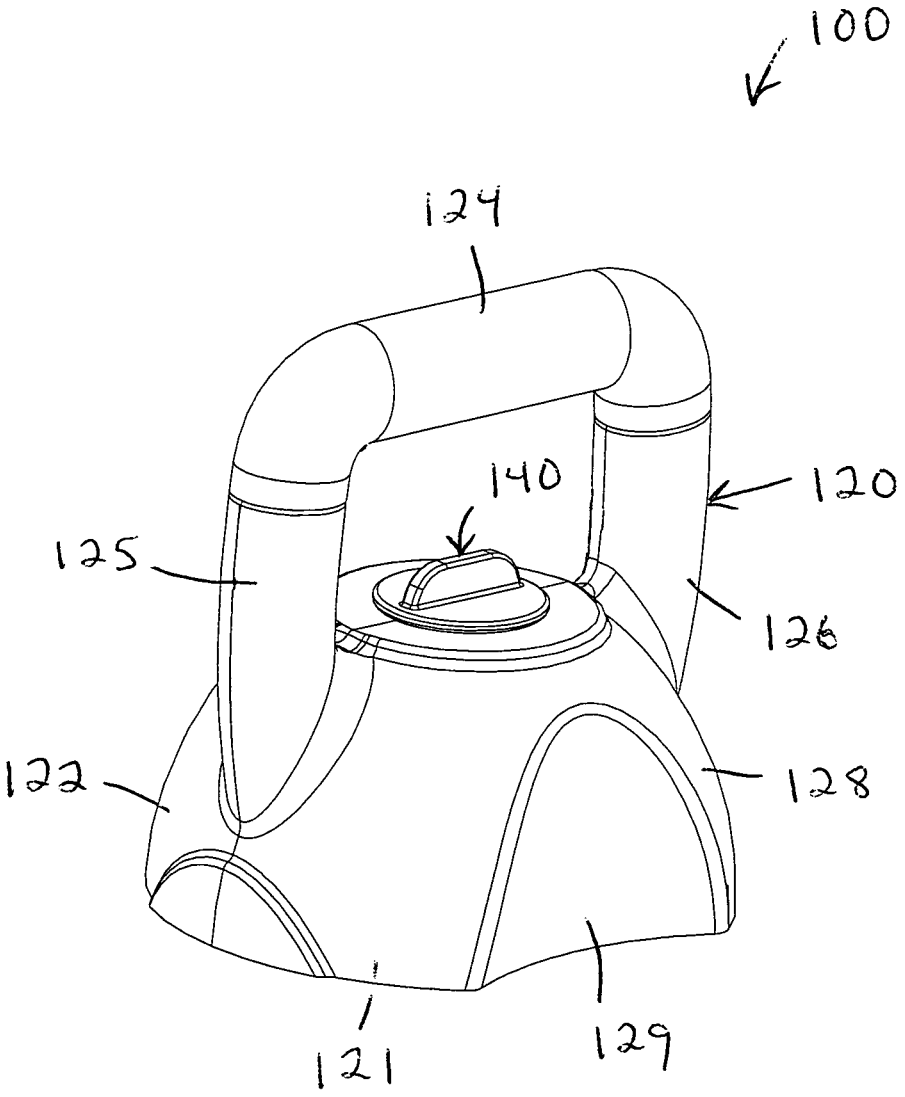
FIG. 1 is a perspective view of an adjustable weight kettlebell constructed according to the principles of the present invention.
Figure 2:
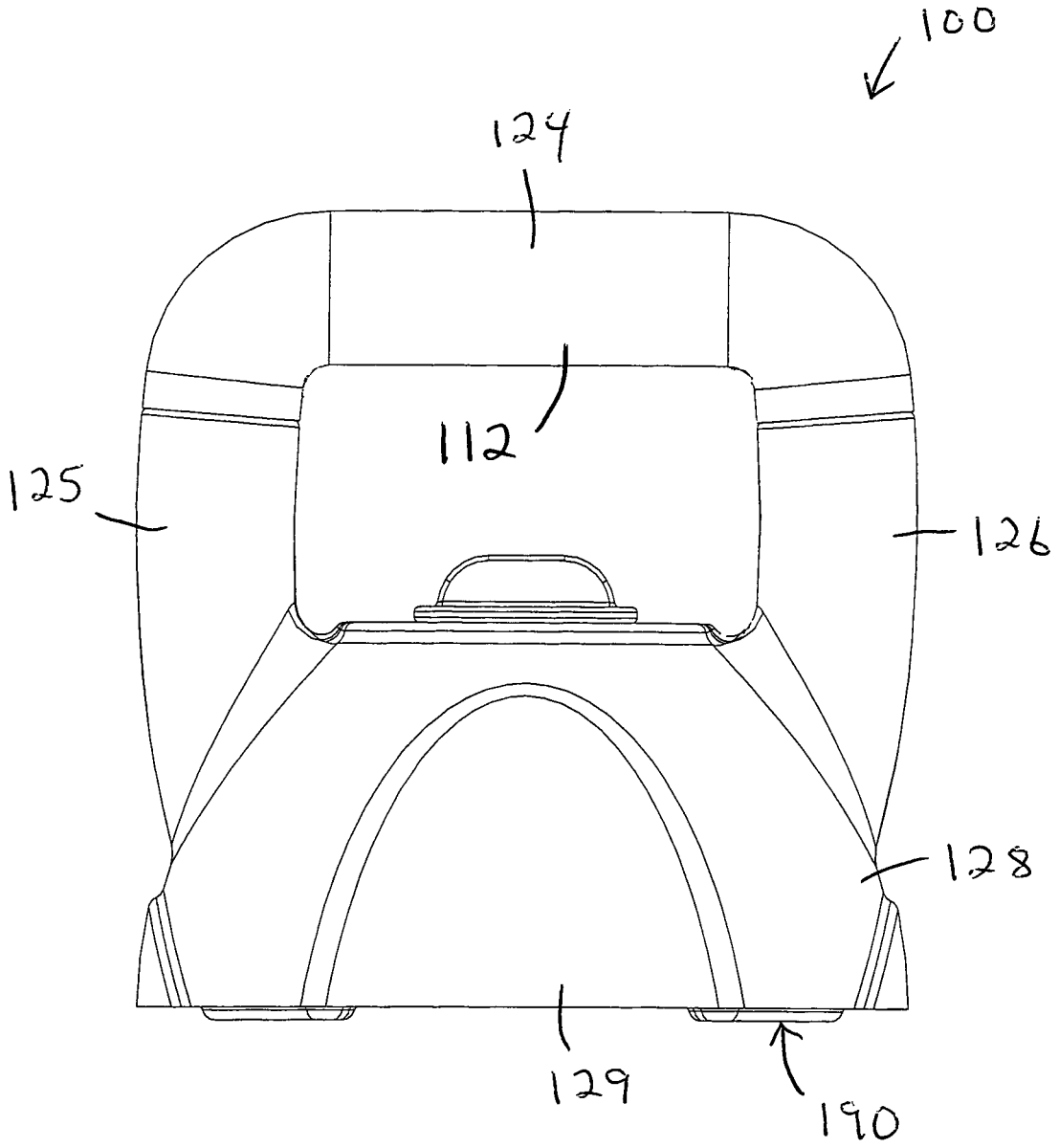
FIG. 2 is a front view of the kettlebell of FIG. 1.

FIGS. 1-2 show a preferred embodiment kettlebell 100 constructed according to the principles of the present invention. Generally speaking, the kettlebell 100 includes a weight lifting member or handle member 120, and (as shown in FIG. 3) at least two weights 180 and 190 selectively secured thereto by means of a weight selector 140 that is rotatably mounted on the weight lifting member 120.

The weight lifting member 120 is preferably made by connecting two injection molded parts or halves 121 and 122 to one another (via sonic welding, adhesive, fasteners, snap fit, and/or other suitable means known in the art). The weight lifting member 120 includes a centrally located, horizontal handlebar 124 that is sized and configured for grasping, and that preferably has an oval cross-section. The handlebar 124 is integrated into the molded parts 121 and 122, but may be provided as a separate part in the alternative. The handlebar 124 is shown with a vinyl overcoat 112. The weight lifting member 120 also includes left and right, vertical handle segments 125 and 126, which cooperate with the handlebar 124 to define an inverted U-shaped handle having three discrete graspable segments.

Figure 3:
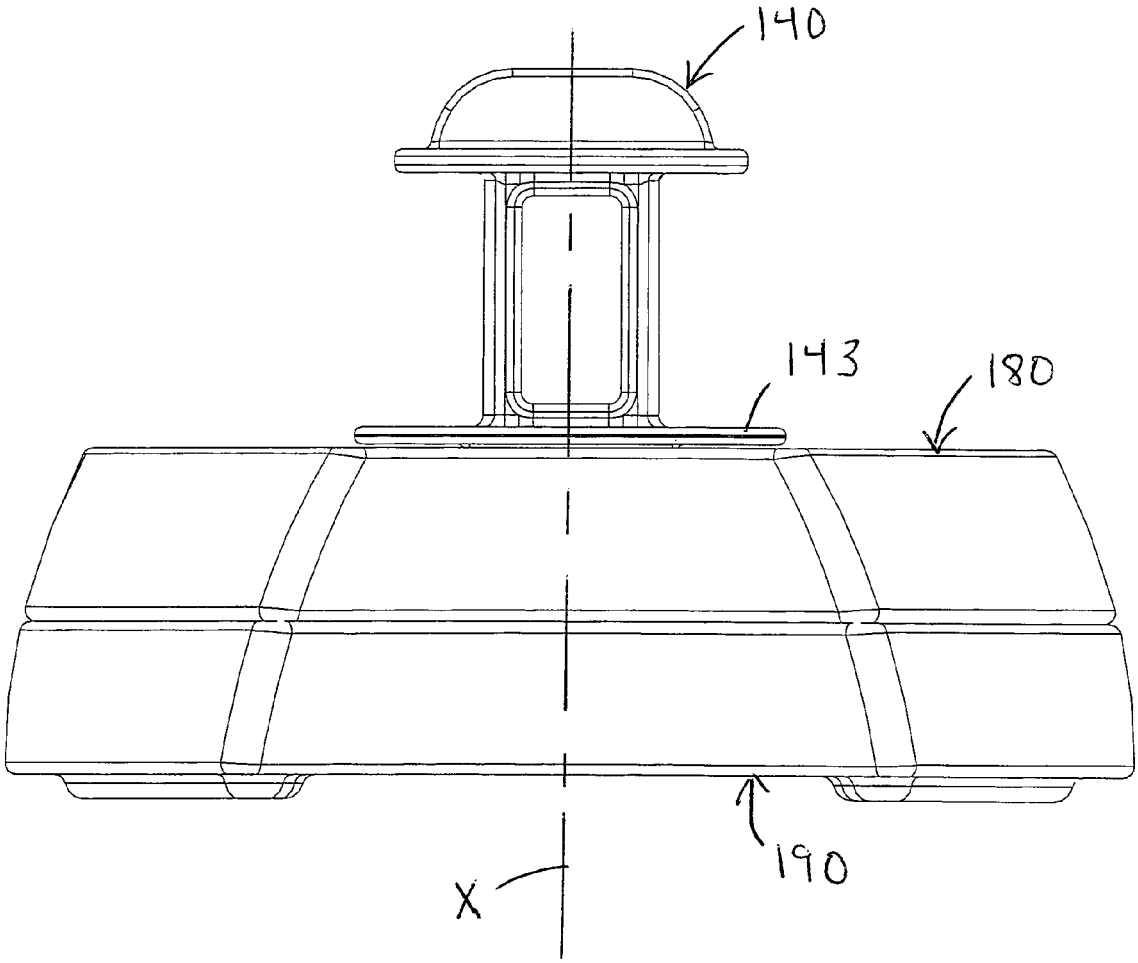
FIG. 3 is a front view of certain components of the kettlebell of FIG. 1, including a stack of weight plates and a weight selector.
Figure 5:
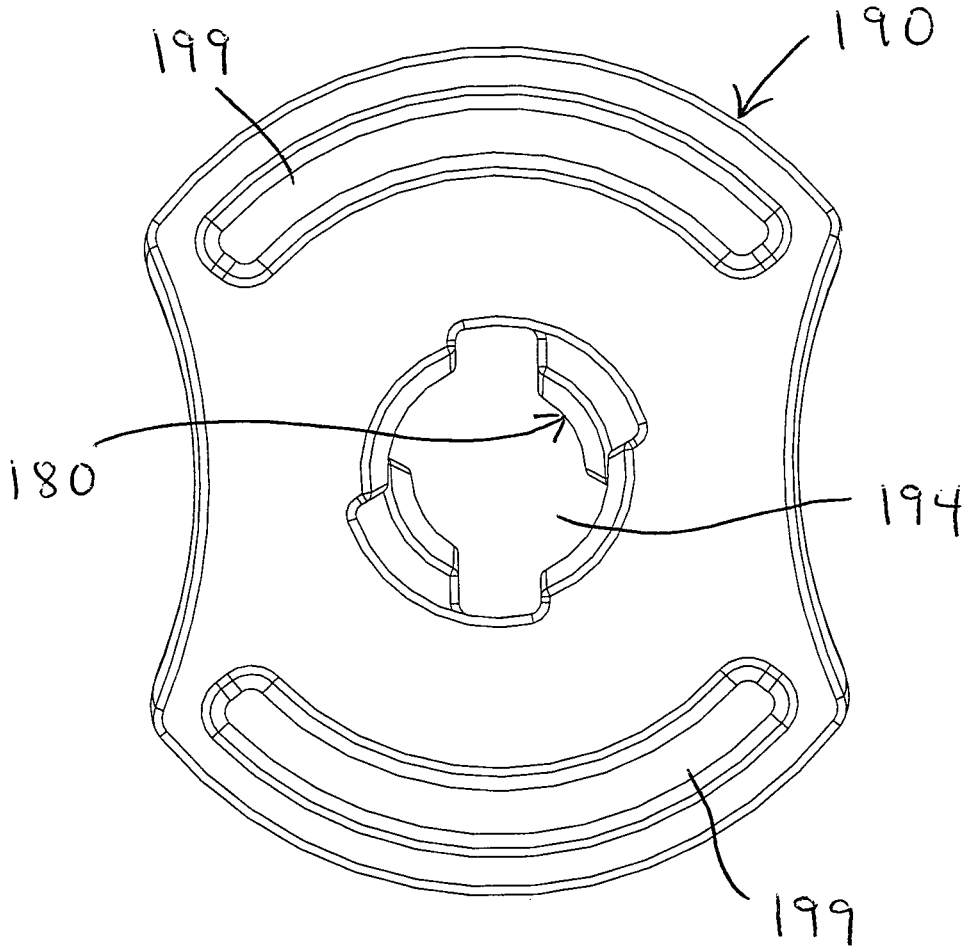
FIG. 5 is a bottom view of the stacked weight plates of FIG. 3.
Figure 6:
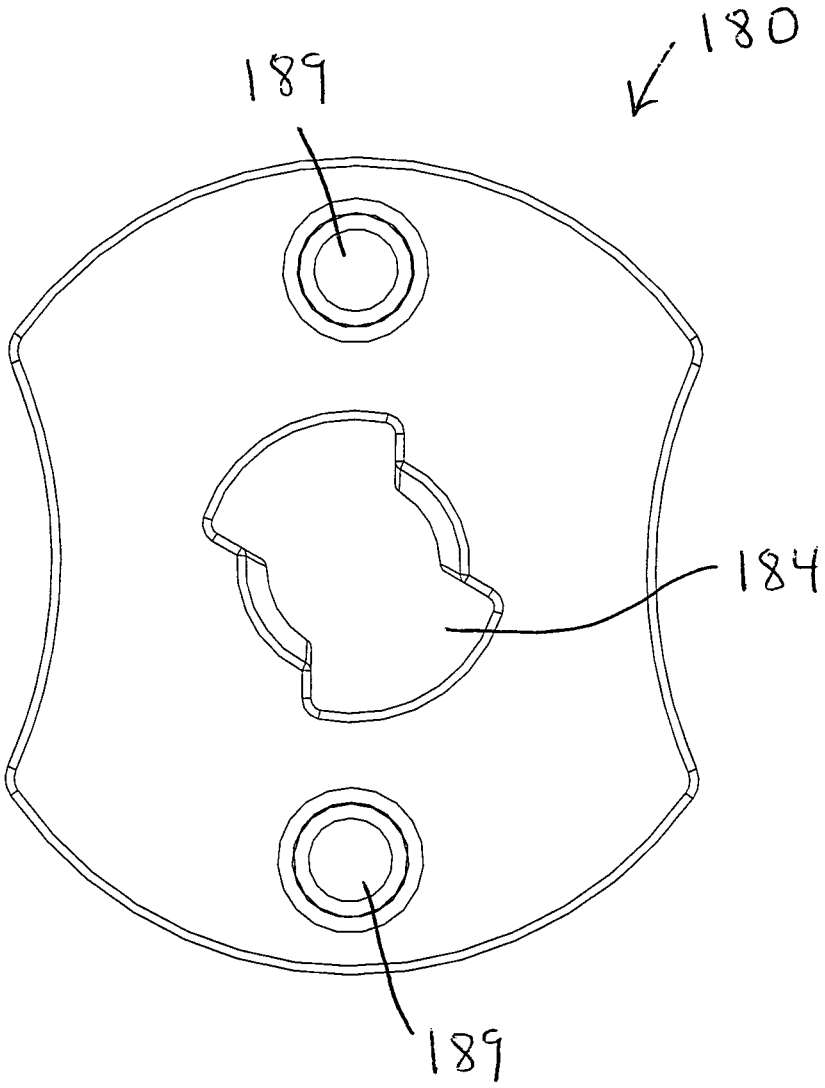
FIG. 6 is a bottom view of the uppermost weight plate of FIG. 3.

The lower ends of the segments 125 and 126 are connected to a weight supporting section 128, which may be described as a downwardly opening housing or box that is sized and configured to cover or fit over the weights 180 and 190 (shown in FIGS. 3 and 5-6). The resulting housing may also be described in terms of shrouding an interface defined between the weights 180 and 190, thereby reducing the likelihood of a person being pinched. The weight supporting section 128 cooperates with a peripheral portion of at least the upper weight 180 to maintain a desired orientation between the weight lifting member 120 and at least the upper weight 180. Recesses or scallops 129 are provided in the front and back sidewalls of the housing 128 to accommodate or bear against a person's forearm.

The weight lifting member 120 is also preferably configured to receive and retain a fixed weight or ballast between the two molded parts 121 and 122. On the depicted embodiment 100, the ballast cooperates with the other parts of the handle member 120 to define a starting weight or unloaded weight of four pounds. Each of the weights 180 and 190 is also configured to weigh four pounds. In other words, the kettlebell 100 is selectively adjustable between four and twelve pounds in four pound increments.

Figure 4:
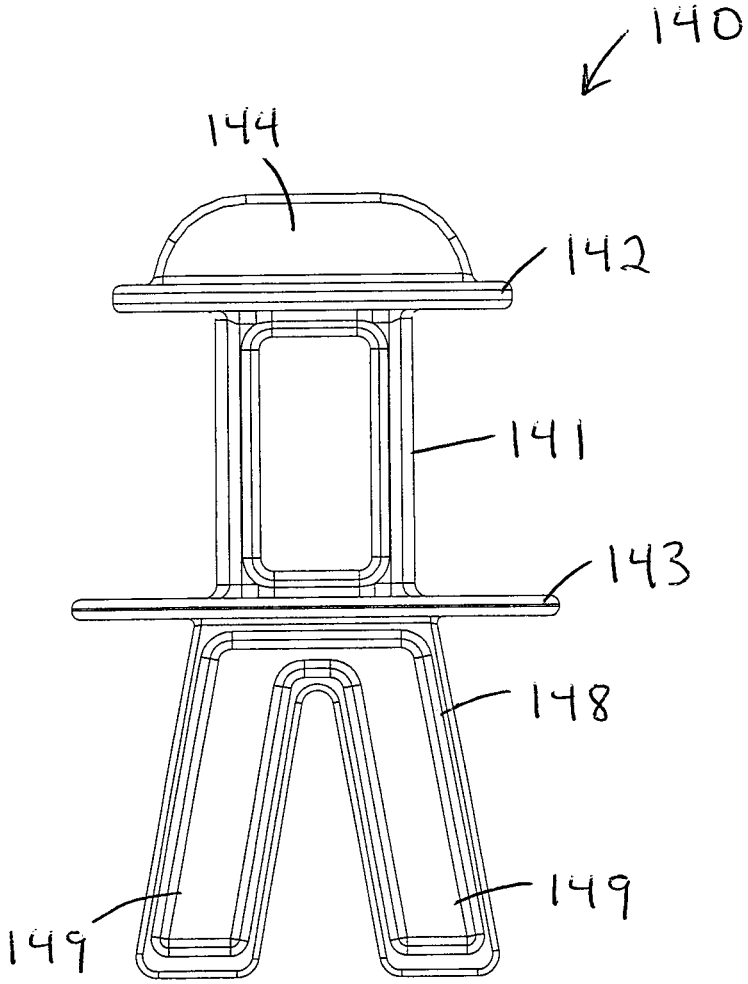
FIG. 4 is a front view of the weight selector of FIG. 3.

The weight selector 140, which is preferably a unitary piece of injection molded plastic, is shown by itself in FIG. 4. The weight selector 140 includes a neck or shaft 141 that extends between a pair of flanges 142 and 143. The weight lifting member parts 121 and 122 include wall sections that fit between the flanges 142 and 143 and about the shaft 141 to rotatably connect the weight selector 140 to the weight lifting member 120. A tab or handle 144 projects upward from the upper flange 142 and is sized and configured for manual operation. The tab 144 and the upper flange 142 may be alternatively described as a knob. An inverted V-shaped tab 148 projects downward from the lower flange 143 and selectively engages the upper weight 180, as further described below. Diametrically opposed prongs 149 project downward from opposite sides of the tab 148 to selectively engage the lower weight 190, as further described below.

The tab 148 may be described as an upper weight retaining member, and the prongs 149 may be described as a lower weight retaining member, and the tab 148 may be described as interconnected in series between the prongs 149 and the shaft 141. In the alternative, the tab 148 and the prongs 149 may be described collectively as a unitary weight retaining member, in which case, the tab 148 may be described as an upper portion of the weight retaining member, and each prong 149 may be described as a lower portion of the weight retaining member.

Different arrangements or means may be used to bias the weight selector 140 toward desired orientations relative to the weight engaging section 126 and the weights 180 and 190, and/or to lock the weight selector 140 in desired orientations relative to the weight engaging section 128 and the weights 180 and 190. For example, a leaf spring may be integrated into the weight selector 140 and biased to occupy detent locations defined by the weight lifting member 120 and arranged in an arc about the flange 142. In the alternative, a plunger may be mounted on the weight lifting member 120 and biased to occupy detent locations defined by the flange 142 and disposed circumferentially about the flange 142.

The weights 180 and 190 are stacked as shown in FIG. 3 to accommodate enclosure within the weight supporting housing 128, and to accommodate insertion of the weight selector 140 into openings in the weights 180 and 190. A bottom view of the weight stack is shown in FIG. 5, and a bottom view of the upper weight 180 is shown in FIG. 6.

The upper weight 180 is preferably an injection molded plastic shell that surrounds and contains a relatively denser filler material, and the weight 180 may be described as a plate having a thickness that is measured parallel to the selector axis of rotation X. The upper weight plate 180 preferably includes openings or depressions in its upwardly facing or top surface that register with pegs that project downward from the weight housing 128. The pegs on the weight housing 128 cooperate with the openings to maintain a fixed orientation between the weight lifting member 120 and the weight plate 180 when the former is adjacent the latter. The upper weight plate 180 also includes pegs 189 that project downward from its downwardly facing or bottom surface. The pegs 189 on the upper weight plate 180 cooperate with openings or depressions in the lower weight plate 190 to maintain a fixed orientation between the upper weight plate 180 and the lower weight plate 190 when the former is adjacent the latter.

A centrally located hole 184 extends through the upper weight plate 180, in a direction perpendicular to the thickness of the upper weight plate 180. The hole 184 may be described in terms of a conical bore and a straight-walled slot or keyway that intersect with one another. The slot accommodates passage of the weight selector 140 through the upper weight plate 180 when properly oriented relative thereto. The bore accommodates rotation of the weight selector 140 when the tab 148 occupies the hole 184, and the sidewalls of the bore overlie the tab 148 when the weight selector 140 is properly oriented relative thereto.

The lower weight 190 is also preferably an injection molded plastic shell that surrounds and contains a relatively denser filler material, and the weight 190 may also be described as a plate having a thickness that is measured parallel to the selector axis of rotation X. The lower weight plate 190 preferably includes openings or depressions in its upwardly facing or top surface that register with the pegs 189 that project downward from the upper weight plate 180. The pegs 189 on the upper weight plate 180 cooperate with the openings in the lower weight plate 190 to maintain a fixed orientation between the weight plates 180 and 190 when they are stacked as shown in FIG. 3. The lower weight plate 190 also preferably includes protrusions or ridges 199 that project downward from its downwardly facing or bottom surface, thereby elevating the bulk of the weight plate 190 relative to an underlying support surface.

A centrally located hole 194 extends through the lower weight plate 190, in a direction perpendicular to the thickness of the lower weight plate 190. The hole 194 may be described in terms of a conical bore and a straight-walled keyway or slot that intersect with one another. The slot accommodates passage of the weight selector 140 through the lower weight plate 190 when properly oriented relative thereto. The bore accommodates rotation of the weight selector 140 when the prongs 149 occupy the hole 194, and the sidewalls of the bore overlie the prongs 149 when the weight selector 140 is properly oriented relative thereto. The openings 194 and 184 cooperate to define three different weight selecting orientations for the weight selector 140, sixty degrees apart from one another.

When the tab 148 and the prongs 149 are aligned with the slots in both weight plates 180 and 190, the tab 148 is free to move upward relative to the upper weight plate 180, and the prongs 149 are free to move upward relative to both weight plates 180 and 190, so the weight lifting member 120 is free to move upward relative to both weight plates 180 and 190 (in response to a lifting force of at least four pounds).

When the tab 148 and the prongs 149 are rotated beneath the angled sidewalls in the upper weight plate 180, the tab 148 underlies the upper weight plate 180, and the prongs 149 are free to move upward relative to the lower weight plate 190, so only the upper weight plate 180 is constrained to move upward together with the weight lifting member 120 (in response to a lifting force of at least eight pounds).

When the prongs 149 are rotated beneath the angled sidewalls in the lower weight plate 190, the prongs 149 underlie the lower weight plate 190, so both weight plates 180 and 190 are constrained to move upward together with the weight lifting member 120 (in response to a lifting force of at least twelve pounds). When the selector 140 is oriented in this manner on the depicted embodiment 100, the tab 148 rotates out from under the upper weight plate 180, so the weight of both weight plates 180 and 190 is carried by the prongs 149. On an alternative embodiment, the upper weight plate may be configured with a relative smaller slot to keep the selector tab in engagement with the upper weight plate when the lower weight plate is engaged by the prongs.

The present invention has been described with reference to specific embodiments and a preferred application. Recognizing that this disclosure will enable persons skilled in the art to derive various modifications, improvements, and/or applications that nonetheless embody the essence of the invention, the scope of the present invention is to be limited only to the extent of the following claims.

What is claimed is:

1. An exercise kettlebell, comprising:

a handle portion having a first end, an opposite, second end, and an intermediate portion extending between the first end and the second end, wherein the intermediate portion is sized and configured for grasping in a person's hand; and a base portion rigidly secured to each said end of the handle portion, wherein the base portion has a lowermost edge that is configured to rest in a stable position on a floor surface with the intermediate portion of the handle portion disposed a vertical distance above the base portion, and the base portion is configured to define an outer circumferential sidewall having a majority portion that is outwardly convex, and a minority portion that is outwardly concave, and the minority portion is bounded by downwardly diverging left and right edges that extend to respective left and right lower ends at the lowermost edge of the base portion, wherein the base portion is symmetrical relative to a vertical plane of symmetry that extends through the minority portion and perpendicularly through a cross-section of the intermediate portion of the handle portion.

2. The exercise kettlebell of claim 1, wherein the left and right downwardly diverging edges have respective left and right upper ends that curve into alignment with one another and join one another.

3. The exercise kettlebell of claim 1, wherein the sidewall is bounded by a relatively larger closed curved loop proximate the lowermost edge of the base portion, and a relatively smaller closed curved loop at a higher section of the base portion.

4. The exercise kettlebell of claim 1, wherein each said portion of the kettlebell is immovably connected to every other said portion of the kettlebell, thereby defining a fixed unitary shape.

5. An exercise kettlebell, comprising:

a handle portion having a first end, an opposite, second end, and in intermediate portion extending between the first end and the second end, wherein the intermediate portion is sized and configured for grasping in a person's hand; and a base portion rigidly secured to each said end of the handle portion, wherein the base portion has a lowermost edge that is configured to rest in a stable position on a floor surface with the intermediate portion of the handle portion disposed a vertical distance above the base portion, and the base portion is configured to define an outer convex circumferential sidewall having a primary outer surface that is interrupted along a parabolic-shaped juncture by a concave recessed surface, and an uppermost portion of the concave recessed surface is equal distance from each said end of the handle portion, wherein the concave recessed surface is bounded by downwardly diverging left and right edges that extend to the lowermost edge of the base portion, wherein the base portion is symmetrical relative to a vertical plane of symmetry that extends through the concave recessed surface, and wherein the concave recessed surface is sized and configured to accommodate at least a portion of a person's forearm when the intermediate portion of the handle portion is grasped in a person's accompanying hand.

6. The exercise kettlebell of claim 5, wherein a first said concave recessed surface is defined in a first portion of the sidewall, and a second said concave recessed surface is defined in a diametrically opposed, second portion of the sidewall.

7. The exercise kettlebell of claim 5, wherein the recessed surface is relatively deeper nearer the lowermost edge of the base portion, and relatively shallower at a higher section of the base portion.

8. The exercise kettlebell of claim 5, wherein the primary outer surface is an upwardly converging domed surface that is relatively larger in curvature at the lowermost edge of the base portion, and relatively smaller in curvature at a higher section of the base portion.

9. The exercise kettlebell of claim 5, wherein each said portion of the kettlebell is immovably connected to every other said portion of the kettlebell, thereby defining a fixed unitary shape.

10. An exercise kettlebell, comprising:

a handle portion having a first end, and an opposite second ends, and an intermediate portion extending between the first end and the second end, wherein the intermediate portion is sized and configured for grasping in a person's hand; and a dome-shaped base portion, wherein the first end and of the handle is rigidly secured to a first portion of the base portion, and the second end of the handle is rigidly secured to a diametrically opposite, second portion of the base portion, and the base portion has a lowermost portion that is configured to rest in a stable position on a floor surface with the intermediate portion of the handle portion disposed a vertical distance directly above the base portion, and the base portion relatively larger in closed curve circumference proximate the floor surface, and the base portion relatively smaller in closed curved circumference at a higher elevation above the floor surface, wherein the base portion is bounded by a circumferential sidewall having a majority portion that is outwardly convex, and a minority portion that is outwardly concave, and an uppermost portion of the minority portion is disposed an equal distance from each said end of the handle, wherein the minority portion is bounded by respective left and right upwardly converging edges having respective left and right lower ends that extend to the lowermost edge of the base portion, wherein the base portion is symmetrical relative to a vertical plane of symmetry that extends through the minority portion.

11. The exercise kettlebell of claim 10, wherein the base portion is bounded by a discrete top surface apart from the circumferential sidewall and disposed said distance beneath the intermediate portion of the handle portion, and the left and right upwardly converging edges have respective left and right upper ends that curve into alignment with one another and join one another beneath the discrete top surface.

12. The exercise kettlebell of claim 10, wherein the minority portion is relatively deeper proximate the lowermost portion of the base portion, and relatively shallower at a higher portion of the base portion.

13. The exercise kettlebell of claim 10, wherein the circumferential sidewall has another minority portion, and an uppermost portion of the another minority portion is disposed an equal distance from each said end of the handle, and each said minority portion occupies a respective, diametrically opposed portion of the base portion.

14. The exercise kettlebell of claim 10, wherein ballast weight is affixed to the base portion, and thereby constrained to move together with the base portion during use of the kettlebell.

15. The exercise kettlebell of claim 10, wherein the base portion defines a downwardly opening compartment, and further comprising at least one weight releasably secured to the base portion inside the downwardly opening compartment for movement together with the base portion during use of the kettlebell.

16. The exercise kettlebell of claim 10, wherein the base portion is bounded at least in part by a closed loop exterior surface that curves 360 degrees around a vertical axis that intersects the intermediate portion of the handle portion.

17. The exercise kettlebell of claim 10, wherein the base portion has an uppermost portion, and the intermediate portion of the handle portion is disposed above said uppermost portion.

18. A hand-held exercise device, comprising:

a handle portion having a first end, an opposite, second end, and an intermediate portion extending between the first end and the second end, wherein the intermediate portion is sized and configured for grasping in a person's hand;

a dome-shaped shell, wherein a first end of the handle portion is rigidly secured to a first portion of the shell, and the second end of the handle portion is rigidly secured to a diametrically opposed, second portion of the shell, and a lowermost edge of the shell is configured to rest in a stable position on a floor surface with the shell opening downward toward the floor surface, and the intermediate portion of the handle portion disposed a vertical distance above the shell to at least accommodate a person's fingers wrapped about the intermediate portion of the handle portion, and the shell is relatively larger in circumference proximate the floor surface, and relatively smaller in circumference at a higher elevation above the floor surface, wherein the shell defines an outer circumferential sidewall having a majority portion that is outwardly convex, and a minority portion that is outwardly concave, wherein the minority portion is bounded by downwardly diverging edges, and an uppermost portion of the minority portion is disposed equal distance from the first end of the handle and the second end of the handle, wherein the shell is symmetrical relative to a vertical plane of symmetry that extends through the minority portion; and a weight releasably secured inside the shell, wherein the shell shrouds the weight except from below.

19. The hand-held exercise device of claim 18, wherein a weight engaging member has an upper end portion connected to an upper portion of the shell, and an opposite, lower end portion suspended inside the shell, and the weight is releasably mounted on the lower end portion of the weight engaging member.

20. The hand-held exercise device of claim 18, wherein the base portion has an uppermost portion, and the intermediate portion of the handle portion is disposed above said uppermost portion.

21. An exercise kettlebell, comprising:

a handle portion having a first end, an opposite, second end, and an intermediate portion extending between the first end and the second end, wherein the intermediate portion is sized and configured for grasping in a person's hand; and a base portion configured to occupy an upright orientation relative to a horizontal floor surface with the intermediate portion of the handle portion disposed a vertical distance above the base portion, and a first vertical plane of symmetry extending through the intermediate portion of the handle portion, and a second vertical plane of symmetry extending through the handle portion and perpendicular to the first vertical plane of symmetry, wherein the base portion defines an outer circumferential sidewall having (a) a first outwardly convex sidewall portion disposed on a first side of the first vertical plane of symmetry, (b) a second outwardly convex sidewall portion disposed on an opposite, second side of the first vertical plane of symmetry, (c) a first outwardly concave sidewall portion disposed on a first side of the second vertical plane of symmetry and bisected by the first vertical plane of symmetry, and (d) a second outwardly concave sidewall portion disposed on an opposite, second side of the second vertical plane of symmetry and similarly bisected by the first vertical plane of symmetry, and wherein the first end of the handle portion extends downwardly away from the intermediate portion and is rigidly secured to an outwardly facing convex surface on the first outwardly convex sidewall portion, and the second end of the handle portion extends downwardly away from the intermediate portion and is rigidly secured to an outwardly facing convex surface on the second outwardly convex sidewall portion, and when viewed from above, the base portion defines a planform consisting essentially of (a) diametrically opposed first and second outwardly convex planform portions defined by the first outwardly convex sidewall portion and the second outwardly convex sidewall portion, respectively, and (b) diametrically opposed, first and second outwardly concave planform portions defined by the first outwardly concave sidewall portion and the second outwardly concave sidewall portion, respectively, and wherein each of the outwardly concave planform portions provides clearance for a person's forearm when the intermediate portion of the handle portion is grasped in a person's associated hand.

22. The exercise kettlebell of claim 21, wherein the intermediate portion is disposed entirely above an uppermost point on the outer circumferential sidewall, and as measured perpendicular to the first vertical plane of symmetry, a maximum width of the kettlebell is defined between the opposite first and second ends of the handle portion.

23. An exercise kettlebell, comprising:

a handle portion having a first end, an opposite, second end, and an intermediate portion extending between the first end and the second end, wherein the intermediate portion is sized and configured for grasping in a person's hand; and a base portion configured to occupy an upright orientation relative to a horizontal floor surface with the intermediate portion of the handle portion disposed a vertical distance above the base portion, wherein the base portion defines an outer circumferential sidewall having (a) an outwardly convex sidewall portion, (b) an outwardly concave sidewall portion, and (c) a juncture defined between the outwardly convex sidewall portion and the outwardly concave sidewall portion, wherein the juncture has opposite, upwardly converging left and right sides that curve into alignment with one another and join one another in a manner that defines an upwardly convex arc, and wherein the first end of the handle portion extends downwardly away from the intermediate portion and is rigidly secured to an outwardly facing convex surface on a first side of the outwardly convex sidewall portion, and the second end of the handle portion extends downwardly away from the intermediate portion and is rigidly secured to an outwardly facing convex surface on an opposite, second side of the outwardly convex sidewall portion, and wherein the base portion is symmetrical relative to a vertical plane of symmetry that bisects both the outwardly concave sidewall portion and the intermediate portion of the handle portion, and when viewed from above, the base portion defines a planform having an outwardly convex planform portion defined by the outwardly convex sidewall portion and an outwardly concave planform portion defined by the outwardly concave sidewall portion, wherein the outwardly concave sidewall portion provides clearance for a person's forearm when the intermediate portion of the handle portion is grasped in a person's associated hand.

24. The exercise kettlebell of claim 23, wherein the intermediate portion is disposed entirely above an uppermost point on the outer circumferential sidewall, and as measured perpendicular to the first vertical plane of symmetry, a maximum width of the kettlebell is defined between the opposite first and second ends of the handle portion.

25. An exercise kettlebell, comprising:

a handle portion having a first end, an opposite, second end, and an intermediate portion extending between the first end and the second end, wherein the intermediate portion is sized and configured for grasping in a person's hand; and a base portion rigidly secured to each said end of the handle portion at respective locations beneath the intermediate portion, wherein the base portion is configured to occupy an upright orientation relative to a horizontal floor surface with the intermediate portion of the handle portion disposed a vertical distance above the base portion, and a vertical axis extending through a midpoint of the intermediate portion of the handle portion, and the base portion defines an outer circumferential sidewall surrounding the vertical axis, wherein along a lowermost edge of the sidewall, the sidewall has an outwardly convex portion and an outwardly concave portion, wherein the outwardly concave portion defines a lower edge of an outwardly concave recess in the sidewall, and the outwardly concave recess is also bounded by upwardly converging left and right edges that curve into alignment with one another and join one another in a manner that defines an upwardly convex arc, and wherein the base portion is symmetrical relative to a plane of symmetry that contains the vertical axis and bisects the outwardly concave portion, and the outwardly concave portion accommodates at least a portion of a person's forearm when the intermediate portion of the handle portion is grasped in a person's accompanying hand.

26. The exercise kettlebell of claim 25, wherein a discrete plane of symmetry contains the vertical axis and extends perpendicular to said plane of symmetry, and another outwardly concave sidewall portion is disposed on a side of the discrete plane of symmetry opposite the outwardly concave sidewall portion to alternatively accommodate at least a portion of a person's forearm when the intermediate portion of the handle portion is grasped in a person's accompanying hand.

27. The exercise kettlebell of claim 25, wherein the intermediate portion is disposed entirely above an uppermost point on the outer circumferential sidewall, and as measured perpendicular to the first vertical plane of symmetry, a maximum width of the kettlebell is defined between the opposite first and second ends of the handle portion.

28. The exercise kettlebell of claim 25, wherein the sidewall defines a closed curve comprising diametrically opposed first and second outwardly convex curve segments and diametrically opposed first and second outwardly concave curve segments.

29. An exercise kettlebell, comprising:

a weight having a geometric center, a vertical axis extending through the geometric center, and a planform disposed about the vertical axis and consisting essentially of first and second diametrically opposed outwardly convex portions and first and second diametrically opposed outwardly concave portions; and a handle connected to the weight, wherein the handle has an intermediate portion sized and configured to be grasped in a person's hand at a vertical distance above the weight, and opposite first and second end portions that extend downward from the intermediate portion and toward one another and the weight, and the vertical axis extends through the intermediate portion of the handle and a maximum width of the kettlebell is defined between opposite first and second end portions of the handle.

30. The exercise kettlebell of claim 29, wherein the weight is symmetrical relative to first and second perpendicular planes of symmetry that intersect along the vertical axis.

31. The exercise kettlebell of claim 29, wherein the intermediate portion and each of the end portions is sized and configured to be a discrete graspable segment of the handle.

32. An exercise kettlebell, comprising:

a handle portion having a first end segment, an opposite, second end segment, and an intermediate segment extending between the first end segment and the second end segment, wherein at least the intermediate segment is sized and configured for grasping in a person's hand; and a base portion rigidly secured to each said end segment at respective locations beneath the intermediate segment, wherein the base portion is configured to occupy an upright orientation relative to a horizontal floor surface with the intermediate segment disposed a vertical distance above an uppermost point on the base portion, and a vertical axis extending through a midpoint of the intermediate segment, and the base portion defines an outwardly facing circumferential sidewall surrounding the vertical axis, wherein proximate a lowermost edge of the sidewall, the sidewall has an outwardly convex portion and an outwardly concave portion, and the outwardly concave portion is bounded by upwardly converging left and right edges that curve into alignment with one another and join one another in a manner that defines an upwardly convex arc, and the base portion is symmetrical relative to a plane of symmetry that contains the vertical axis and bisects the arc.

33. The exercise kettlebell of claim 32, wherein as measured perpendicular to the plane of symmetry, a maximum width of the kettlebell is defined between the opposite first and second end segments of the handle portion.

34. The exercise kettlebell of claim 32, wherein the sidewall that defines a closed curve comprising diametrically opposed first and second outwardly convex curve segments and diametrically opposed first and second outwardly concave curve segments.

35. The exercise kettlebell of claim 32, wherein each said segment is sized and configured to be a discrete graspable segment of the handle portion.

* * * * *

UNITED STATES PATENT AND TRADEMARK OFFICE

CERTIFICATE OF CORRECTION

PATENT NO. : 8,784,280 B2
APPLICATION NO. : 12/932847
DATED : July 22, 2014
INVENTOR(S) : Mark A. Krull It is certified that error appears in the above-identified patent and that said Letters Patent is hereby corrected as shown below:

Title page, item [63] insert the following

--Related U.S. Application Data

Continuation of application No. U.S. 12/590,355, filed on November 6, 2009, which is a Nonprovisional of application No. U.S. 61/198,620, filed on November 7, 2008.--

In the Claims

Column 5, in claim 5, line 16, should read: and an intermediate portion extending between the first Column 5, in claim 10, line 61, should read: , end and an intermediate portion extending between the Column 5, in claim 10, line 65, should read: a dome-shaped base portion, wherein the first end of Column 6, in claim 18, line 62, should read: a dome-shaped shell, wherein the first end of the handle Signed and Sealed this
Sixth Day of January, 2015

Michelle K. Lee

Michelle K. Lee
*Deputy Director of the United States Patent and Trademark Office*